US005430980A

United States Patent [19]

Ferrier

[11] Patent Number: 5,430,980

[45] Date of Patent: Jul. 11, 1995

[54] COLLAPSIBLE CUBICLE

[75] Inventor: Walter Ferrier, Cape Town, South Africa

[73] Assignee: Studio 169 CC, Capetown, South Africa

[21] Appl. No.: 150,600

[22] Filed: Nov. 10, 1993

[30] Foreign Application Priority Data

Jul. 14, 1993 [ZA] South Africa ..... 93/5069

[51] Int. Cl.[6] ..... E04B 1/12

[52] U.S. Cl. ..... 52/63

[58] Field of Search ..... 52/63, 79.5, 222, 645; 160/128, 377, 352, 330, 350, 351; 135/900, 901, 902, 104, 106, 90, 107, 108

[56] References Cited

U.S. PATENT DOCUMENTS 3,570,507 3/1971 Kashuba ..... 135/901

4,449,542 5/1984 McSwain et al. ..... 135/901

5,301,706 4/1994 Jones ..... 135/104

*Primary Examiner*—Carl D. Friedman

*Assistant Examiner*—Creighton Smith

*Attorney, Agent, or Firm*—Woodcock Washburn Kurtz Mackiewicz & Morris

[57] ABSTRACT

This invention provides a collapsible cubicle 10 having a tubular enclosure 12 of fabric material secured to a pair of resiliently deformable hoops 18 and 20. In use the enclosure 12 is suspendible from a tripod 32 having a telescopically extendible post 36. A sand bag 34 is conveniently provided to stabilise the erected cubicle 10. The enclosure 12 is conveniently stored for transportation by stacking the hoops 18 and 20 on top of each other and manipulating them by means of a twisting action until they form a composite hoop having a lesser diameter than the undeformed hoops.

2 Claims, 2 Drawing Sheets

COLLAPSIBLE CUBICLE

FIELD OF THE INVENTION

This invention relates to a collapsible cubicle.

BACKGROUND TO THE INVENTION

Outdoor photographic sessions for modelling garments such as beachwear, for example, frequently necessitate the same person to pose in different garments in a chosen location. Since photographic work in outdoor locations generally attracts the attention of passers-by, the persons modelling the garments require a secluded place for changing from one garment into another.

This generally creates inconvenience if the chosen location for a photographic session is a considerable distance away from a building, or any other convenient enclosure for swopping garments out of the view of interested spectators.

The present invention seeks to address this problem.

SUMMARY OF THE INVENTION

The present invention provides a collapsible cubicle which includes a tubular enclosure of fabric material secured to at least two hoops axially spaced from each other, each hoop being resiliently deformable into a composite hoop having a lesser diameter than an undeformed hoop.

The enclosure may include fastening means secured to one of the hoops from which the enclosure is suspendible with the hoops vertically spaced from each other.

A roof of fabric material may be releasably attachable to the enclosure along the periphery of the hoop which is secured to the fastening means. This roof may be circular conveniently serving the dual function of providing overhead cover for the cubicle if this is required, or alternatively to provide a light reflector when it is detached from the enclosure.

The enclosure may further include a zip fastener secured to the fabric material and extending between two hoops to allow access into the cubicle during use.

The cubicle may include a collapsible stand locatable adjacent to the enclosure, for supporting the enclosure during use. More particularly the enclosure may be suspendible from the erected stand by way of the fastening means on the enclosure.

BRIEF DESCRIPTION OF THE DRAWINGS

The invention is described below by way of example with reference to the accompanying diagrammatic drawings in which.

DESCRIPTION OF A PREFERRED EMBODIMENT OF THE INVENTION

Figure 1:
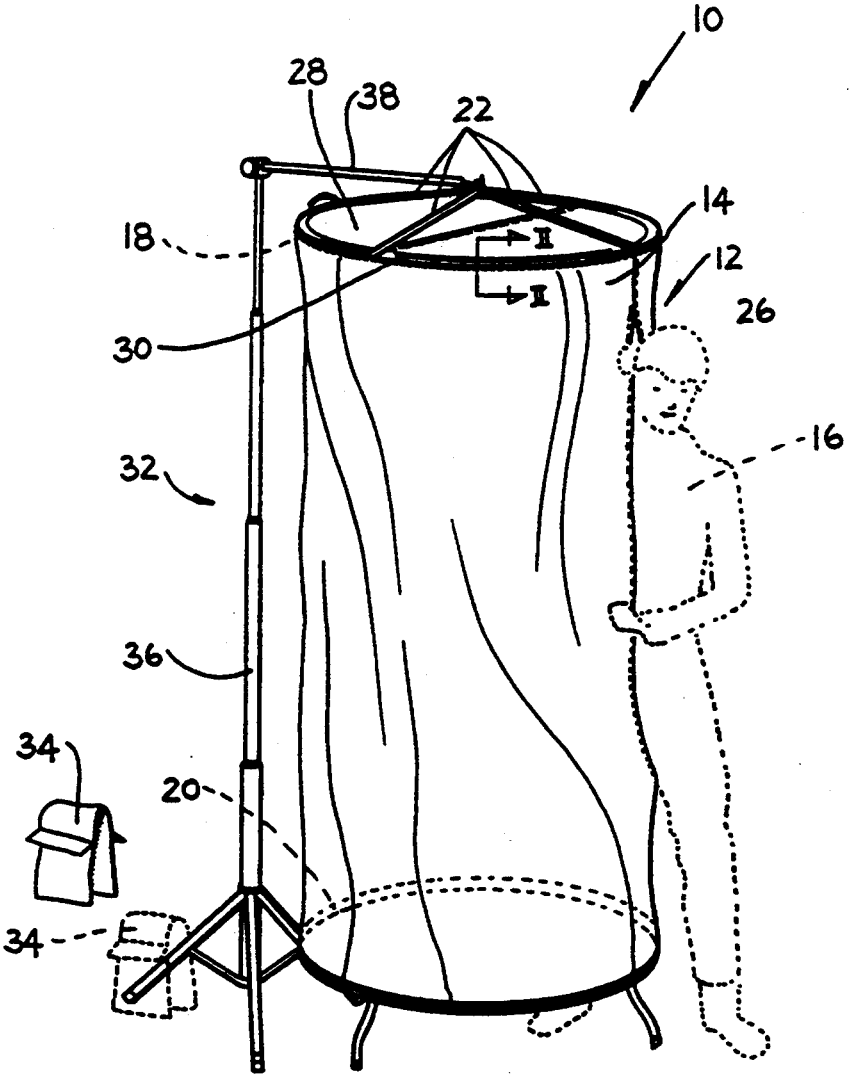
FIG. 1 shows a partially exploded, perspective view of a collapsible cubicle according to the invention, the cubicle being in its functional condition.
Figure 2:
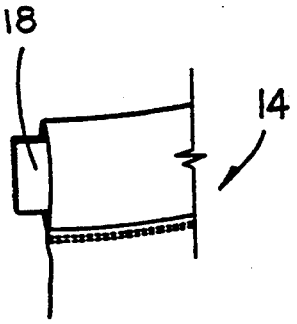
FIG. 2 shows a perspective view of a portion of the cubicle in FIG. 1 on an enlarged scale, viewed along section II—II in FIG. 1.
Figure 3:
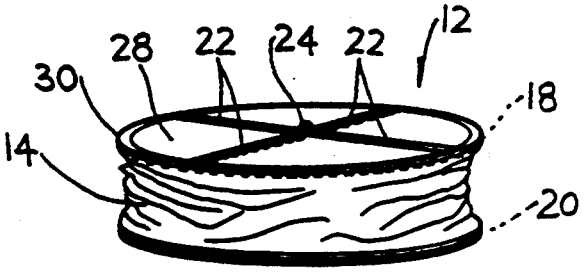
FIG. 3 shows a respective view of a flexible enclosure forming part of the cubicle of FIG. 1, in its collapsed condition.

In the accompanying drawings reference numeral 10 generally identifies a collapsible cubicle according to the invention. The cubicle 10 includes an enclosure 12 having a tubular portion 14 of substantially opaque, reinforced nylon fabric material. The length of the tubular portion 14 in its extended condition is generally longer than that of a fully grown person 16, as indicated in broken outline in FIG. 1. Two flexible steel hoops 18 and 20 are respectively secured towards each end of the tubular portion 14, as illustrated in FIG. 2.

Four woven straps 22 of equal length are each secured by one end to the hoop 18, spaced at regular intervals from each other. The other end of each strap 22 is secured to a common ring 24, which provides a fastening means from which the enclosure 12 is vertically suspendible in use so that the hoops 18 and 20 are vertically spaced from each other.

A zip fastener 26 is sewn into the fabric of the tubular portion 14, and extends axially between the hoops 18 and 20. In use a person 16 is able to gain access to the enclosure 12 by stepping through the opening defined by the zip fastener 26.

The enclosure 12 further includes a detachable circular roof 28 of fabric material, which is releasably attachable to the enclosure by way of a further zip fastener 30. The zip fastener 30 has two elongate complementary portions, one portion extending along the inner periphery of the hoop 18, while the other extends along the outer periphery of the roof 28. The roof 28 conveniently includes a circular panel of white reflective fabric material. A further panel of fabric material identical to that of the tubular portion 14 is secured in back-to-back relationship to the circular panel of white material. In use the roof 28 and tubular portion 14 allow at least a diffuse light into the enclosure 12 when the roof 28 is secured to the enclosure 12, while still providing full privacy to an occupant within the enclosure.

If so required, the roof 28 may be readily detached from the tubular portion 14 and used for other purposes. More particularly the roof 28 may serve as a means for reflecting light onto a subject being photographed. The choice of a white fabric material for the roof 28 is dictated by this optional use.

While it is generally feasible to use the enclosure 12 on its own in conjunction with any available overhead support, the cubicle 10 conveniently includes a tripod 32 and a sandbag 34 to facilitate erection of the cubicle 10 in any chosen location.

The structure of the tripod 32 is of a known design, and includes a telescopically extendible post 36 having a lockable arm 38 pivotally connected towards its free end. When required, the tripod 32 is unfolded and positioned on the ground with two of its feet located adjacent to the hoop 20. The sandbag 34 is conveniently filled with sand, gravel or any other available ballast material, and positioned astride of the third leg of the tripod 32, thereby providing a counterweight for the enclosure 12. The arm 38 is set at right angles to the vertically extendible post 36. The ring 24 on the enclosure 12 is hooked onto a catch towards the unconnected end of the arm 38. The extendible pole 36 is then raised until the tubular portion 14 is fully extended, and then locked.

Figure 5:
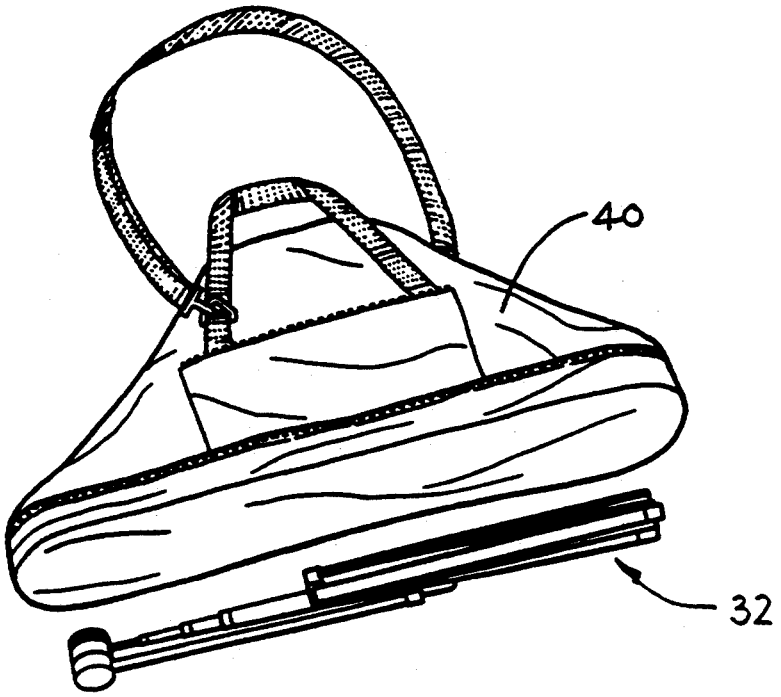
FIG. 5 shows a perspective view of a kit for transporting the cubicle of FIG. 1 in a collapsed condition.

When the cubicle 10 is to be dismantled for storage the process is substantially reversed by lowering the post 36, releasing the enclosure 12 and discarding the contents of the sandbag 34. A carrier bag 40 is conveniently provided as part of a kit comprising the cubicle 10, which is readily transportable in its fully collapsed condition, as illustrated in FIG. 5. The tripod 32 is folded in a known fashion until it fits into a pouch provided in the bag 40.

Figure 4:
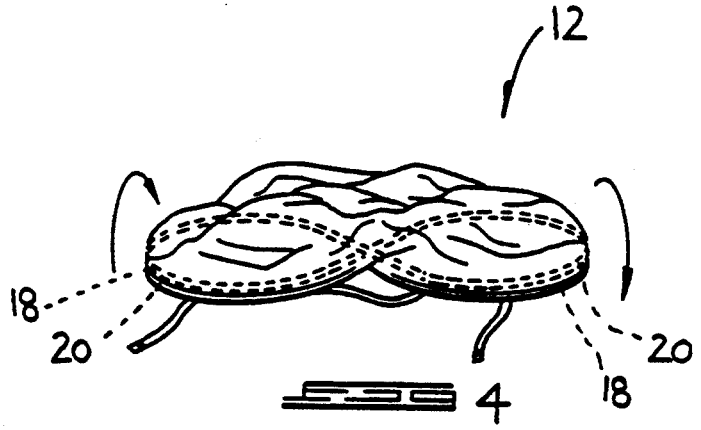
FIG. 4 shows a perspective view of the enclosure of FIG. 3 in a collapsed condition for transportation.

In order to fit the enclosure 12 into the carrier bag 40 the hoops 18 and 20 are stacked on top of each other as shown in FIG. 2. A user grasps the hoops 18 and 20 with both hands at substantially diametrically opposed positions and twists the respective portions of the hoops in opposing directions. This requires a measure of dexterity, but eventually the hoops 18 and 20 are manipulated, first into a figure-of-eight configuration as shown in FIG. 4. The enclosure 12 is then twisted further until the hoops 18 and 20 are deformed into a composite hoop having a lesser diameter than the undeformed hoops. The deformed hoops 18 and 20 are eventually stacked in a more compressed arrangement on top of each other.

The fabric material of the tubular portion 14 and the circular roof 28 is so thin that it does not interfere materially with the stacking arrangement of the hoops 18 and 20. Once the enclosure 12 is in its compressed condition it can be fitted with comparative ease into the carrier bag 40. The empty sand bag 34 is conveniently positioned in the same bag 40, which is closable by means of a zip fastener. The carrier bag 40 with its contents can be slung over a user's shoulder and transported with minimal inconvenience to a new location.

A skilled reader will readily appreciate that the preferred embodiment of the invention described above lends itself to a variety of modifications and adaptations without departing from the essential elements set out in the accompanying claims. The scope of the appended claims should accordingly not be construed as being limited in any way by the features of the preferred embodiment described above.

I claim:

1. A collapsible cubicle which comprising a tubular enclosure of fabric material secured to two hoops axially spaced from each other, each hoop being resiliently deformable into a composite hoop having a lesser diameter than the hoop; a first one of the two hoops having woven straps secured by one end thereto, the other end of each strap being secured to a loop fastening means for suspending the cubicle.

2. The collapsible cubicle of claim 1, which further comprises a roof of flat, flexible fabric material secured to the tubular enclosure along the periphery of the first hoop.

* * * * *